US006773377B1

(12) United States Patent
Yu et al.

(10) Patent No.: US 6,773,377 B1
(45) Date of Patent: Aug. 10, 2004

(54) ROTATABLE HAND EXERCISER

(76) Inventors: Hui-Nan Yu, 14, Lane 252, Chien Kuo Road, Taoyuan (TW); Yuan-Hsing Chu, 104-19, Lane 465, Lien Tsun Road, Feng Yuan City, Taichung Hsien (TW)

( * ) Notice: Subject to any disclaimer, the term of this patent is extended or adjusted under 35 U.S.C. 154(b) by 0 days.

(21) Appl. No.: 10/373,376

(22) Filed: Feb. 24, 2003

(51) Int. Cl.[7] ..... A63B 21/072; A63B 21/22; A63B 23/14

(52) U.S. Cl. ..... 482/45; 482/108; 482/110

(58) Field of Search ..... 482/44–46, 49, 482/50, 91–93, 110, 106, 108

(56) References Cited

U.S. PATENT DOCUMENTS 2,115,926 A * 5/1938 Hatton ..... 473/596
2,546,896 A * 3/1951 Kassuba ..... 473/596
3,672,093 A * 6/1972 Meek, Sr. ..... 446/266
4,150,580 A * 4/1979 Silkebakken et al. ..... 74/5 R
4,165,070 A * 8/1979 Rice ..... 482/46
5,766,112 A * 6/1998 Chuan ..... 482/44
5,941,799 A * 8/1999 Bergdorf ..... 482/44
6,099,444 A * 8/2000 Domenge ..... 482/110
6,629,908 B2 * 10/2003 Hamady ..... 482/45

* cited by examiner

*Primary Examiner*—Nicholas D. Lucchesi
*Assistant Examiner*—Victor Hwang
(74) *Attorney, Agent, or Firm*—Alan D. Kamrath; Nikolai & Mersereau, P.A.

(57) ABSTRACT

A hand exerciser includes a hollow sphere that has four openings and a cruciform member is supported in the sphere. Two handle disks and two massage disks are rotatably connected to four ends of the cruciform member and respectively engaged with the openings. A rod extends from a center of the cruciform member and a spring is mounted to the rod and a tube is rotatably mounted to the rod and biased by the spring. A weight is connected to a lateral rod extending from the tube. The eccentric force by the weight when the sphere is rotated applies a force to the hands holding the handle disks or the massage disks.

3 Claims, 7 Drawing Sheets

ROTATABLE HAND EXERCISER

FIELD OF THE INVENTION

The present invention relates to a hand exerciser that has a hollow sphere in which a cruciform member is connected and a weight is eccentrically connected. The sphere includes two handles and massage portions for hands to hold.

BACKGROUND OF THE INVENTION

Conventional exercising devices are bulky and heavy, and includes complicated structure which usually means a high cost. People usually cannot afford to buy the different types of exercising devices and there is no space for these exercising devices. For those people work in offices, it is important to exercise their hand muscles because of the long time of operating computers. Unfortunately, in the present market, no proper exercising device is provided for the exercise of hands.

The present invention intends to provide a hand exerciser that is a sphere and can be held by hand. A weight is eccentrically installed in the sphere so that when rotating the sphere the muscles of hands can be exercised.

SUMMARY OF THE INVENTION

In accordance with one aspect of the present invention, there is provided with a hand exerciser which comprises a hollow sphere with four openings for two handle disks and two massage disks being engaged therewith. A cruciform member is supported in the sphere and the handle disks and the two massage disks are rotatably connected to four ends of the cruciform member. A rod extends from a center of the cruciform member and a spring is mounted to the rod. A tube is rotatably mounted to the rod and biased by the spring. A weight is connected to a lateral rod extending from the tube.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
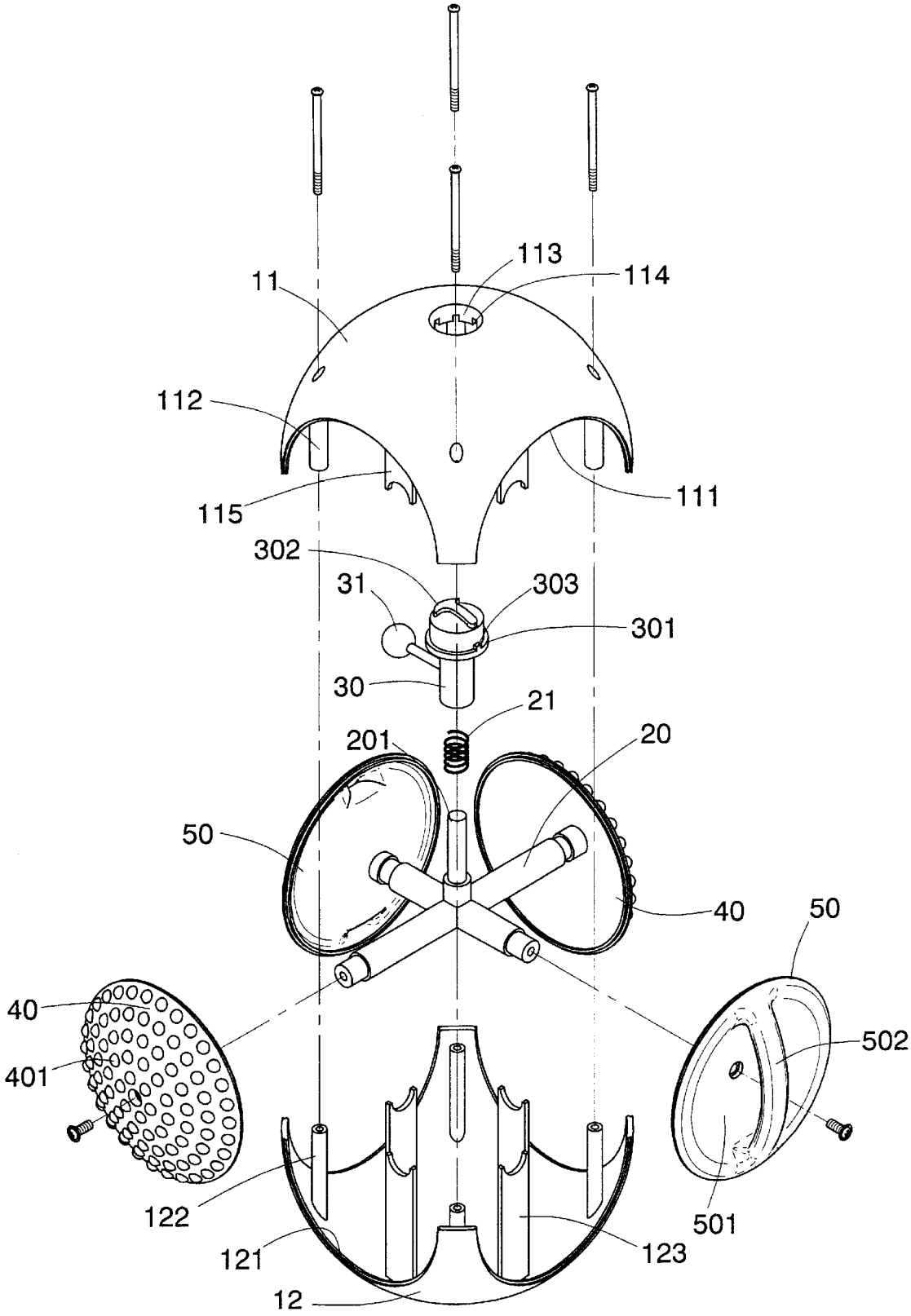
FIG. 1 is an exploded view to show the hand exerciser of the present invention.
Figure 2:
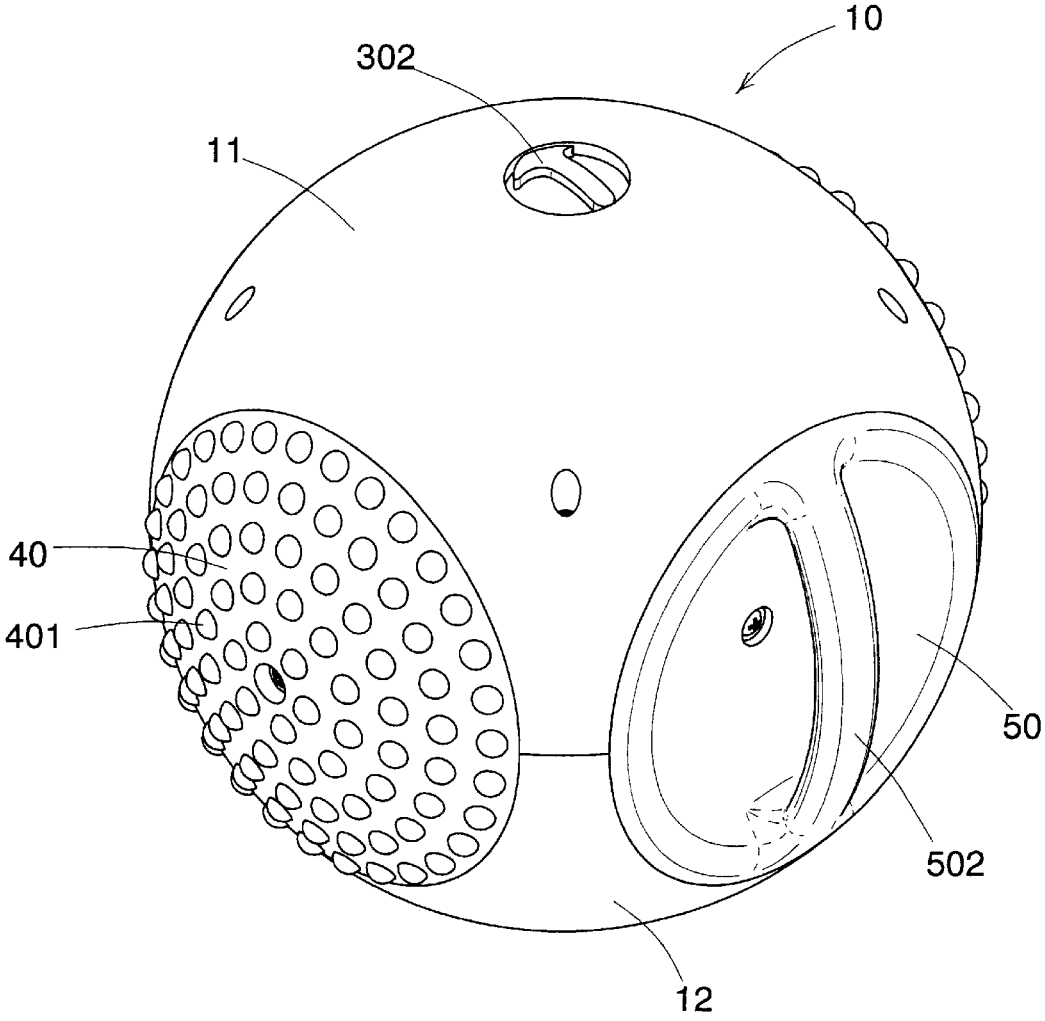
FIG. 2 is a perspective view to show the hand exerciser of the present invention.

Referring to FIGS. 1 and 2, the hand exerciser of the present invention comprises a hollow sphere 10 which is composed of two halves 11, 12. A plurality of support ridges 115/123 extend from an inside of each of the two halves 11, 12, and a cruciform member 20 is positioned between the support ridges 115 and 123 of the two halves 11, 12. Each half 11/12 includes four semi-circular recess 111/121 so as to define four openings when the two halves 11, 12 are connected with each other. A plurality of positioning tubes 112 and 122 respectively extend from the inside of the two halves 11, 12 and bolts extending through the two halves 11, 12 and the aligned positioning tubes 112, 122 to connect the two halves 11, 12. An aperture 113 is defined through a wall of the sphere 10 and a plurality of notches 114 are defined in a lower edge of periphery defining the aperture 113. The notches 114 have different depths.

Two handle disks 50 are rotatably connected to two opposite ends of the cruciform member 20 and engaged with two openings of the sphere 10. Two massage disks 40 having massage protrusions 401 are rotatably connected to the other two opposite ends of the cruciform member 20 and engaged with the other two openings of the sphere 10. The handle disks 50 each include a concave surface 501 and a space is defined between the concave surface 501 and the handle 502.

A rod 201 extends from a center of the cruciform member 20 and a spring 21 is mounted to the rod 201. A tube 30 is rotatably mounted to the rod 201 and biased by the spring 21. A weight 31 is connected to a lateral rod extending from the tube 30. A flange 301 is located on a top of the tube 30 and a boss 303 extends from a top of the flange 301. The boss 303 is engaged with one of the notches 114. An indication needle 302 is connected to the top of the flange 301 so as to indicate the position of the weight 31.

Figure 3:
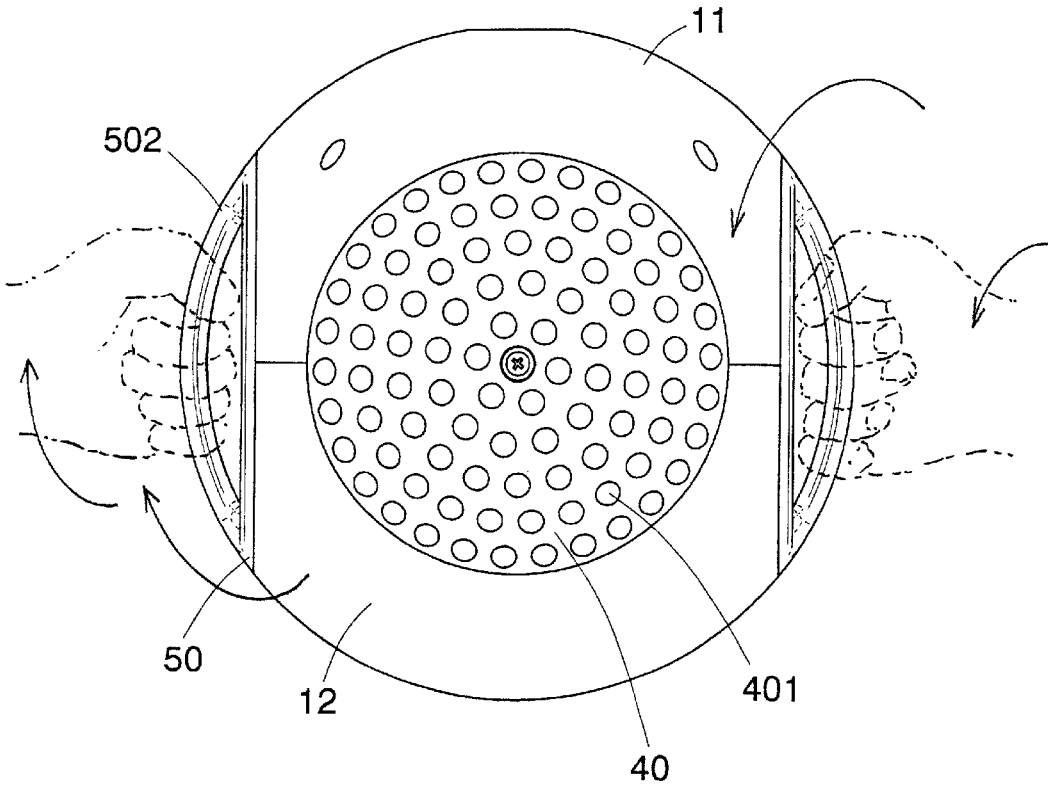
FIG. 3 shows two hands holding the handle disks of the hand exerciser of the present invention.
Figure 4:
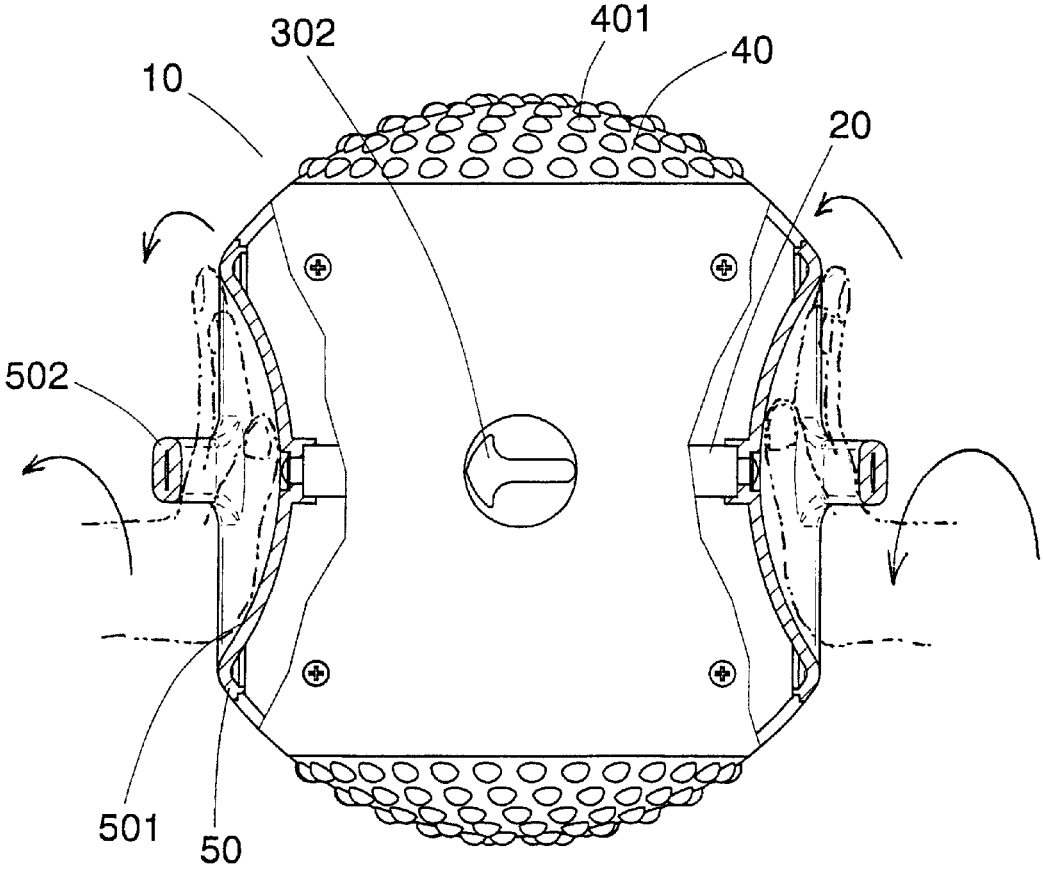
FIG. 4 shows two palms pressing on the handle disks of the hand exerciser of the present invention.
Figure 5:
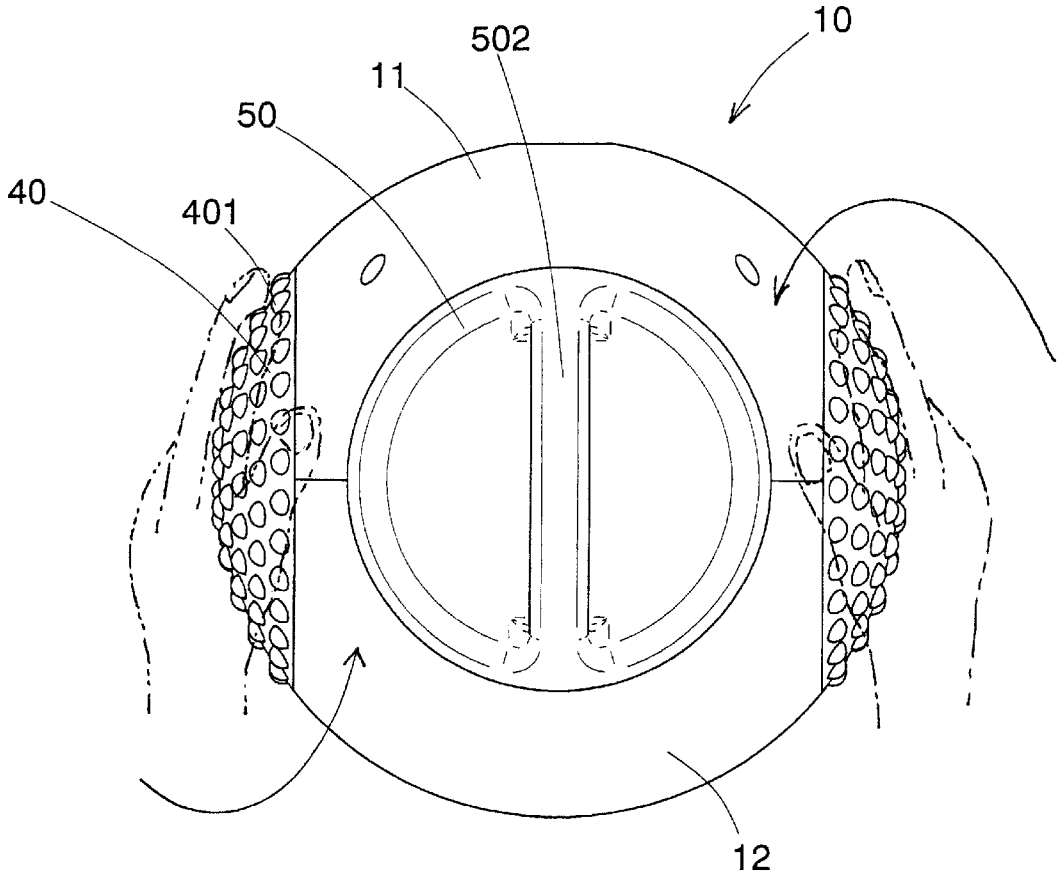
FIG. 5 shows two hands pressing the massage disks of the hand exerciser of the present invention.

Referring to FIGS. 3 and 4, the hands of the user may hold the handles 502 to rotate in opposite direction to exercise the wrists. The palms may also to compress the concave surfaces 501 to rotate the handle disks 50. Referring to FIG. 5, hands may also compress the massage disks 40 to rotate the massage disks 40 in opposite directions.

Figure 6:
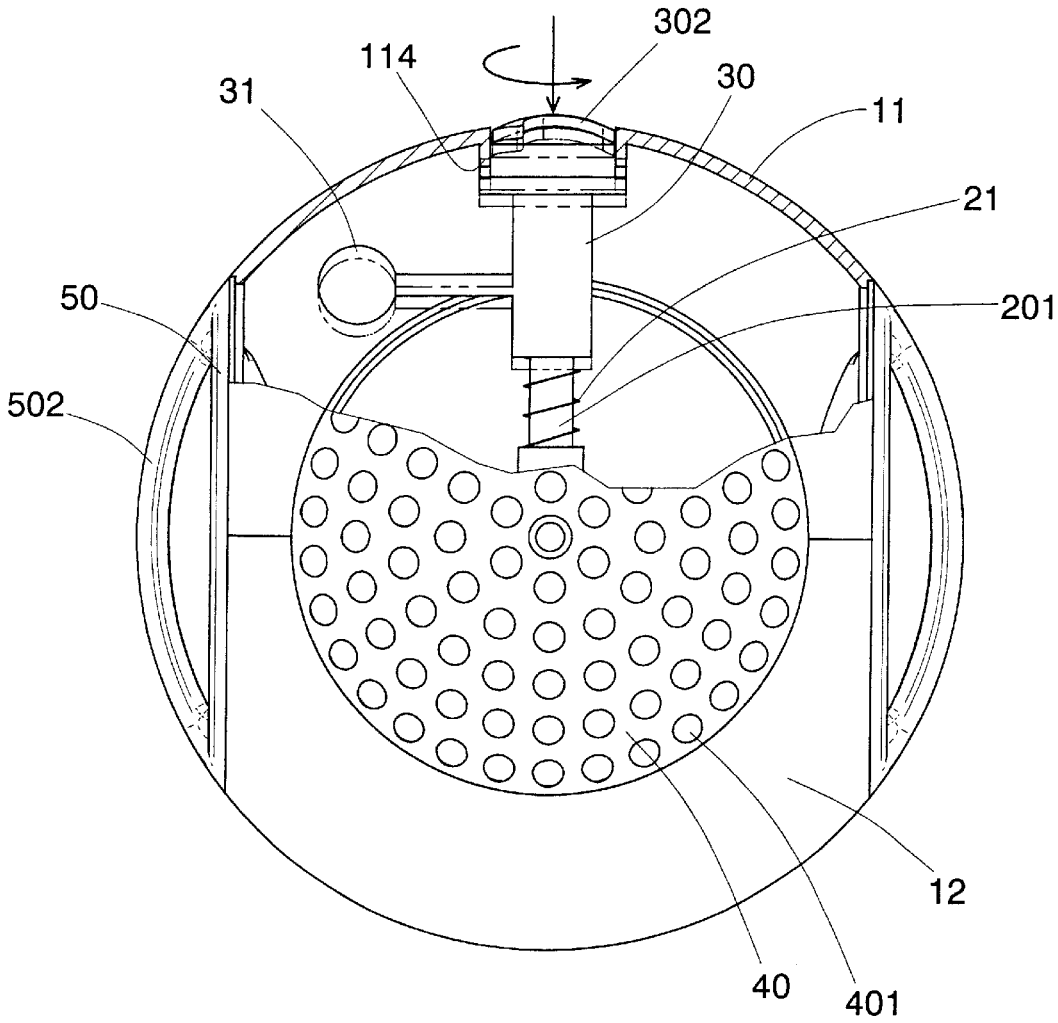
FIG. 6 shows the weight is adjusted at different positions.
Figure 7:
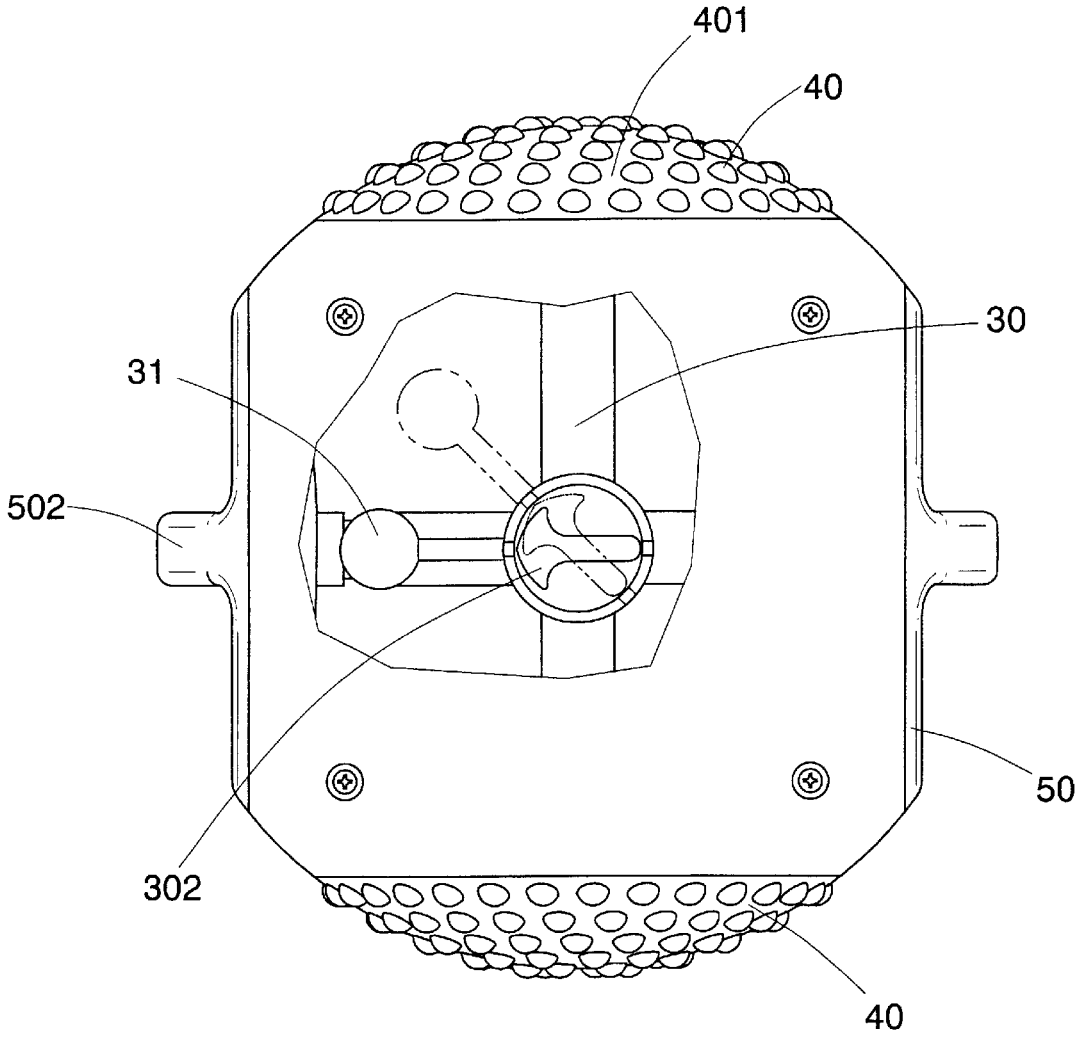
FIG. 7 shows the indication needle is rotated an angle when the positions of the weight are adjusted.

Referring to FIGS. 6 and 7, the indication needle 302 can be pushed downward to compress the spring 21 and disengage the boss 303 from the notch 114. The indication needle 302 is then rotated an angle and to re-engage the boss 303 to another notch 114 with different depth. By this way, the position of the weight 31 to the cruciform member 20 is adjusted. When the sphere 10 is rotated, the rotation of the weight 31 generates an eccentric force which exercise the muscles of the hands.

While we have shown and described the embodiment in accordance with the present invention, it should be clear to those skilled in the art that further embodiments may be made without departing from the scope of the present invention.

What is claimed is:

1. A hand exerciser comprising:

a hollow sphere composed of two halves and a plurality of support ridges extending from an inside of each of the two halves, four openings defined through the hollow sphere, and a cruciform member supported in the sphere and being positioned between the support ridges of the two halves, two handle disks rotatably connected to two opposite ends of the cruciform member, two massage disks rotatably connected to the other two opposite ends of the cruciform member, the two handle disks and the two massage disks engaged with the four openings of the sphere.

2. The hand exerciser as claimed in claim 1 further comprising a rod extending from a center of the cruciform member and a spring mounted to the rod, a tube rotatably mounted to the rod and biased by the spring, a weight connected to a lateral rod extending from the tube, an aperture defined through a wall of the sphere and a plurality of notches defined in a lower edge of periphery defining the aperture, the notches having different depths, a flange located on a top of the tube and a boss extending from a top of the flange, the boss engaged with one of the notches.

3. The hand exerciser as claimed in claim 1 wherein the handle disks each include a concave surface and a space is defined between the concave surface and a handle connected to the handle disk.

* * * * *